United States Patent [19]

Erwin

[11] Patent Number: 4,478,443

[45] Date of Patent: Oct. 23, 1984

[54] POSTAGE METER SECURITY SEAL

[75] Inventor: Timothy R. Erwin, Trumbull, Conn.

[73] Assignee: Pitney Bowes Inc., Stamford, Conn.

[21] Appl. No.: 437,423

[22] Filed: Oct. 28, 1982

[51] Int. Cl.[3] ..... B65D 55/06

[52] U.S. Cl. ..... 292/307 R; 411/910

[58] Field of Search ..... 292/307, 251, 326, 308; 411/910, 121, 183

[56] References Cited

U.S. PATENT DOCUMENTS

| | | | |
|---|---|---|---|
| 279,182 | 6/1883 | Preston | 411/121 X |
| 1,749,043 | 3/1930 | Neiser | 411/910 |
| 2,009,490 | 7/1935 | Gay | 101/91 |
| 4,076,291 | 2/1978 | Pope et al. | 292/307 R X |

FOREIGN PATENT DOCUMENTS

| | | | |
|---|---|---|---|
| 87090 | 6/1896 | Fed. Rep. of Germany | 292/307 R |
| 384802 | 12/1932 | United Kingdom | 292/307 R |

*Primary Examiner*—Richard E. Moore

*Attorney, Agent, or Firm*—Sawyer, Jr. Joseph A.; William D. Soltow, Jr.; Albert W. Scribner

[57] ABSTRACT

Apparatus for sealing a postage meter is disclosed. The sealing apparatus includes a cover with a cut-out portion. The cover portion includes two cover tab receiving openings which are positioned diametrically across from each other. The center of the cut-out portion has a bore hole that runs completely through the thickness of the cover. An insert is provided which is adapted to fit into and mate with the bore hole. The insert contains an opening which will accept a screw and also contains upwardly extending tabs. A screw is used to fasten the sealing apparatus to the postage meter. When the tabs are stacked over the screw, it is impossible to remove the screw without first breaking off the tabs. A broken tab will thus indicate that the meter has been tampered with.

16 Claims, 5 Drawing Figures

POSTAGE METER SECURITY SEAL

BACKGOUND OF THE INVENTION

This invention relates to a specific security sealing device that is particularly adapted for use in the housings of valuables. More specifically, the present invention relates to a tamper-proof sealing means for postage meters and the like.

There are known many types of tamper-proof sealing means used in containers housing valuables or in structures where security is important. In one type of security means, the lock comprises two members adapted for automatic interlocking engagement on the introduction of one member into a cavity of the other member. The first member generally is a rod shaped body with a tapered insertion end and with an abruptly restricted cross-sectional area slightly rearward of the tapered section to form a shoulder. Single engagement locks of this type are disclosed in U.S. Pat. Nos. 3,730,578 and 1,553,188. In the single lock ring engagement disclosed in U.S. Pat. No. 3,730,578 the second member is a block with throughgoing openings, the diameter of which is smaller at the end where the rod shaped body is introduced than at the opposite end. This opposite end is closed by an inserted sleeve provided with a bore facing the interior of the block and of the same diameter as the smallest diameter of the throughgoing openings. Such a single lock is used partly as a padlock but specifically as a seal, for instance, on containers for transport of goods. The opening of the lock requires the use of force and the fact that the lock is intact should indicate that no unauthorized person has had access to the interior of the container.

However, it was found that a lock of this type could be opened and relocked without leaving any direct signs of the use of force and thus the security in this type system would be lost. Furthermore, the interlocking of the two members was not very secure because the lock could be opened by impact or by means of a crowbar. In the single engagement lock disclosed in U.S. Pat. No. 1,553,188 the aforesaid lock ring is replaced by a tubular sleeve open at both ends. Theoretically, this results in an improved interlocking connection between the two members of the lock; this lock can also be broken by a relatively simple operation since the block member consists of porcelain or plastic material.

There are also disclosed in the prior art various other fasteners or security devices wherein the locking connector is of the type which has two similar elements that are interlocked together. It may be desirable in this type of security system that the connector not be releasable because of the desired permanancy of the connection being made. A connector that cannot be released except by obvious destruction would provide such a seal. The use of such destructible seals can be effective in reducing tampering or the theft of the contents of a container. Such a connector would probably not, however, provide ultimate security for the reason that it is preferably made of plastic-like material that could be relatively easily cut and replaced. This type of security device is disclosed in U.S. Pat. No. 3,897,162.

Prior art construction of security seals or other types of devices in many instances consists of expensive components that are also difficult to use. Some of these seals or devices require expensive tools in order that they can be appropriately installed or closed; these devices also do not totally eliminate the possibility of undesired tampering or manipulation. Another known construction involves the use of a metal strip drawn through the opening or openings of an article which is to be sealed. After the sheet metal strip is flexed over upon itself, it can be riveted at both of its ends by tongs or pliers. The rivet location is subsequently covered with a plastic cap. With this construction seal, there is the drawback that riveting of the metal strip is not undertaken in a completely faultless manner. Tampering or manipulation for the purposes of providing a false seal or giving the appearance that the article has in fact been sealed is possible. Also known is a system which involves a seal whereby both ends of a flexible strip are associated with rather bulky closure elements. Thus, this construction of seal cannot be employed in those instances in which the opening or openings of the article to be sealed is small, especially in conjunction with openings for the use of convenient closing devices such as screws and the like. Also these devices are generally difficult to install or expensive for volume use. While these seals do provide assurance that unauthorized openings have not occurred, such seals can generally be circumvented. This is done by anyone having access to a supply of seals by simply replacing a broken seal with a new one. Counterfeiting seals also would not be difficult for someone willing to go through the considerable time and expense involved. These prior art devices which utilize a frangible or destructible device have been described in various patents, for example Dutch patent application No. 7,412,131 or U.S. Pat. Nos. 2,142,048; 3,983,645 and 3,924,800. Devices like these are used for dispatching documents in transportation bags. One such device takes the form of a flat envelope having along one of the edges a zip fastener which in closed position is sealed by means of a rupturable or frangible sealing member. In order to be able to establish afterwards that the transportation bag has been opened by a person authorized to do so, one must be able to ascertain if the seal is original or a replacement. With such a sealing device, it would be possible to reapply the sealing member quickly and without the use of aids, thus giving the impression that the sealing member was never broken. In the Dutch patent above noted, the elastic means which are to be deformed are formed by resilient lips projecting from the shaft portion of the sealing member. In the head of the sealing member, there is formed a slit wherein a special tool can be engaged for twisting said sealing member in order to break it. It is obvious, however, that in addition to being complex, a design such as this leads to a relatively high cost for the manufacture of this sealing member, especially upon volume and continued use. There is thus a need to provide a simple and relatively inexpensive sealing device of the type that will be described herein in which no specific or expensive tools are required to break the sealing member.

SUMMARY OF THE INVENTION

It is therefore a principal object of this invention to provide a device to detect unauthorized entry into the interior of a postage meter.

An additional object of this invention is to provide a security sealing means for postage meters that will discourage attempts at the pilfering and tampering of the interior portions of postage meters.

Still another object of this invention is to provide a tamper indicating sealing device which may be attached in addition to postage meters to any container housing any type of valuable object.

Another further object of this invention is to provide an efficient postage meter locking means that may be economically manufactured according to various strict government specifications.

A still further object is to provide a postage meter security means whereby a readily visible seal is provided and whose destruction is very easily determined.

Still another further object of this invention is to provide a simple sealing element for postage meters that is clearly exposed, and can be inexpensively manufactured.

And yet a further object of this invention is to provide a security sealing means that is easily replaced or installed when properly destroyed by authorized personnel.

Another further object of this invention is to provide a sealing means for postage meters which fully satisfies the security requirements of several countries, including the United States.

The foregoing objects and others are accomplished in accordance with this invention by providing a novel postage meter sealing means comprising a cover having therein an aperture or cut out portion having a circular configuration. This cut out portion is provided with two cover tab receiving openings positioned diametrically across from each other. The center of the cut out portion has a cover bore hole or seal receiving element that runs completely through the thickness of said cover. A second element or security seal insert is adapted to snugly fit into and mate with the bore hole portion. In the center of said insert is a screw bore or tunnel that will align with the screw receptable portion. A screw can be easily inserted into the screw bore and will extend through to connect the security seal insert to the cover. Extending above and outwardly from the top of the security seal insert are two tabs that will fit snugly into the covered tab openings. Once the screw has been inserted and threaded into the security seal insert, and connected to the cover via mating with the cover cut out, the screw can be tightened and fixed into position. The tabs then are staked over the screw head, preventing the removal of the screw. Once the tabs have been staked over the screw head, the interior of the postage meter cannot be entered without first breaking the tabs so that the screw can be loosened by any tool or screw driver. Once the tabs are broken off to remove the screw to gain access to the interior of the meter for servicing new security seal inserts can be installed into the postage meter cover.

It is thus impossible to remove the screw without first breaking off the tab in order to gain operational access to the screw. A broken tab will indicate that the meter had been tampered with.

The security seal device of this invention is econonomically manufactured and is particularly advantageous for large volume usage. The screw used with the device of this invention can be any conventional type of screw; however, it is preferred that a break-off screw be used which gives the security system of this invention a higher degree of security. A break-off screw is the type of screw whereby the top snaps off after the screw is tightened and an additional twisting action is exerted on it. There are many conventional and known break-off screws that are available, any suitable form of this screw may be used. The security element of this invention is preferred to be positioned in the bottom panel or portion of the postage meter; however, it may be located on any part of the meter cover or skirt that is convenient. It is also preferred that four separate and individual devices of the present invention be used in each panel corner; however, any number of devices, even only one security seal element, can be used. The tabs on the security device of this invention can be broken off by prying with a screwdriver of any other suitable tool. Also, the tabs could have distinguishing markings on their face so that it would minimize the chance of counterfeiting.

Any suitable material may be used to manufacture the security seal inserts of this invention. Suitable materials are, for example, linear polyoxymethylene-acetal resin made by the polymerization of formaldahyde and having a high strength and being solvent resistant. These type of materials are moldable and have been used in aerosol containers. It is important that the security seal inserts used, in particular, the tabs that are broken away, be made of material that is not easily repaired by an adhesive or glue. Once the screw is replaced, the tabs are again staked down upon the head of the screw by any suitable type of system. It is preferred that the staking be accomplished by the use of ultrasonic staking. In ultrasonic staking, the assembly method uses a controlled melting and reforming of a plastic stud or tab to capture or lock another component or, in this case, a screw in place. The plastic tab protrudes through a hole in the component to be locked in place or upward as in the present device. High frequency vibrations of the ultrasonic horn are imparted on the top of the tab which melts to produce a head locking the screw in place. The progressive melting of plastic under the continuous but generally light pressure deforms the tab of this invention over the head of the screw. The advantages of ultrasonic staking include short cycle time (generally less than one second), tight assemblies with virtually no tendency for recovery, the ability to perform multiple stakes with system. Other advantages are substantial control over the process, design simplicity and the elimination of consumables in the staking process. The integrity of an ultrasonically staked assembly depends upon the volumetric relationship between the tab and system used, and the ultrasonic parameters used when forming the tab or melting it down.

Proper stake design produces optimum strength and appearance with minimum flash. There are several configurations of ultrasonic staking available; the principal of staking, however, is the same in each. The area of initial contact between the staking apparatus and the staked tab or stud should be kept to a minimum, thus concentrating the energy to produce a rapid melt. In ultrasonic staking the most common set of parameters involved contacting the tab using high amplitude and low pressure and allowing the molten material of the tab to flow over the screw head. Some high melt temperature thermoplastics, especially crystaline resins, tend to form a weak, brittle head. In these cases, using the standard profile staking tip, high pressure, high amplitude and high trigger pressures may give best results. Another approach to obtaining higher strength when staking crystalline resins uses the combination of high pressure, low amplitude and high trigger pressure. The material yields under high pressure and the heat generated by the ultrasonic vibrations, and mushrooms just above the top of the tab with no flash and no recovery. In this invention, the ultrasonic staking of the tab melts the tab portion over the screw head and prevents anyone from gaining access to the screw without first breaking the tab that is melted thereon. A desirable type of tab material to use in the present invention is Delren, a trade name of the Dupont Company; Delren is of the class of materials commonly known as acetal resins.

The preferred embodiment of the invention is illustrated in the accompanying drawings and descriptions.

DESCRIPTION OF THE PREFERRED EMBODIMENT OF THIS INVENTION

Figure 1:
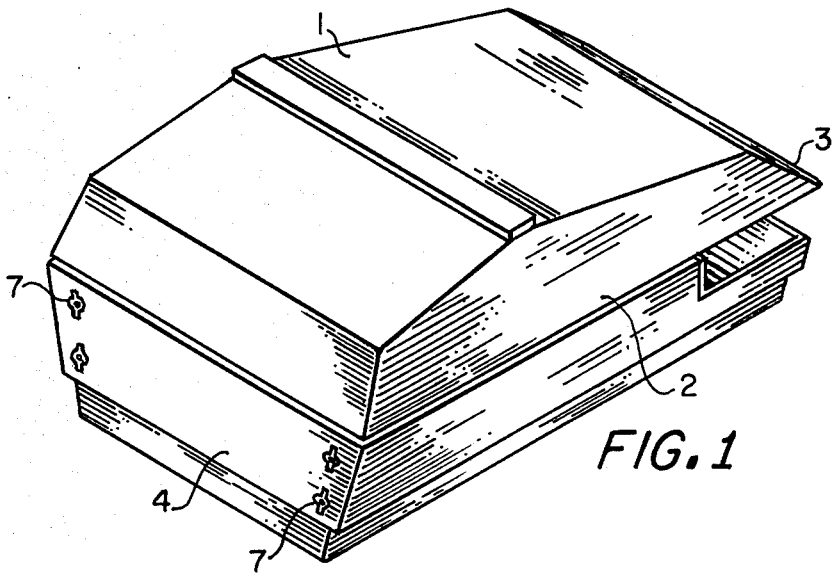
FIG. 1 is a perspective view of the sealed postage meter showing the location of the sealing unit in the back skirt or cover of the postage meter.

FIG. 1 illustrates a postage meter 1 which is equipped with a container housing or skirt 2 that encloses the mechanism for servicing the postage meter. The mechanics for setting the postage meter value or servicing the postage meter are all contained within the housing or skirt of the postage meter 1. The front 3 of the postage meter usually contains the external controls that operate the meter during use. The back of rear panel 4 of the postage meter contains the security device of this invention. However, it is preferred that the security device of this invention be placed at the bottom portion or panel of the postage meter so that it is not in view of the user. For purposes of clarity only, the drawing illustrates the security device as being located in the back portion of postage meter 1. Illustrated herein is the use of four separate security sealing means 7, each being positioned at the corners of the back panel.

Figure 2:
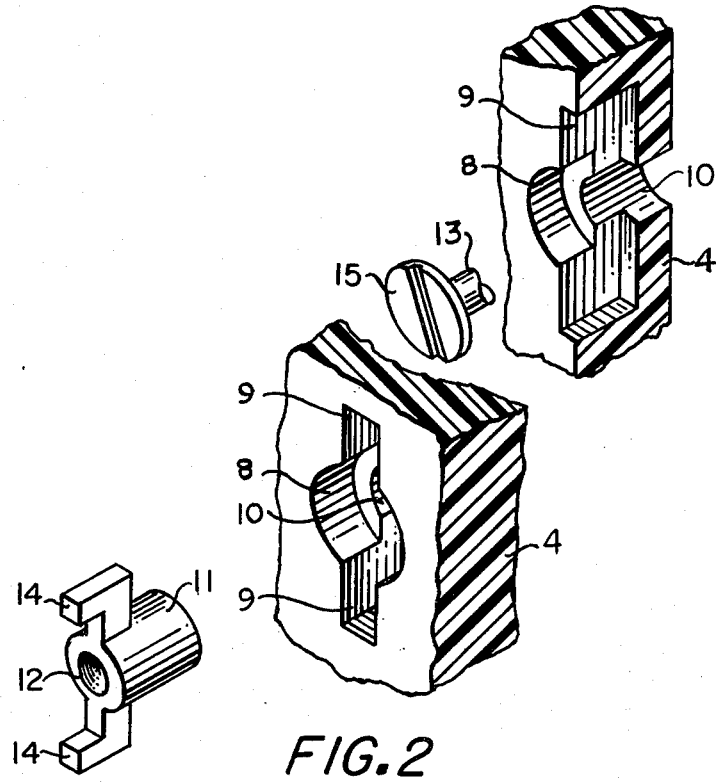
FIG. 2 is a perspective view of the security sealing insert and the cover with the cut out or apertured portion therein.

FIG. 2 illustrates the security seal insert 11 which is adapted to mate and fit snugly into aperture or cut out portion 8. Panel 4 has therein an aperture or cut out portion 8 having a circular configuration with two tab receiving openings 9 positioned diametrically across from each other. The center of the cut out portion 8 has a cover bore hole or seal receiving element 10 that runs completely through the thickness of postage meter cover 4. A second element or security seal insert 11 is adapted to fit into and mate with the cut out portion 10. In the center of said insert 11 is a screw bore or tunnel 12 that will align with the screw receptacle. A screw 13 therefore can be inserted into the screw bore 12 and will extend through to connect the security seal insert 11 to the meter frame. Screw bore 12 is not threaded.

Extending above and outwardly from the top of security seal insert 11 are two tabs 14. These tabs will fit into the cover tab openings 9 and will mate therewith. Once the screw 13 has been inserted into the security seal insert 11 and connected to the postage meter frame, the screw 13 can be tightened and fixed into position. The two tabs 9 are then staked over the screw heads 15 preventing the removal of the screws 13 from the insert 11. Once the tabs 14 have been staked over the screw heads 15, the interior of the postage meter cannot be entered without first breaking the staked tabs 14. After the tabs are broken, the screw 13 can be turned and loosened by a tool or screw driver and new security seal inserts 11 may be readily installed into the postage meter cover 4. It is apparent that it is impossible to remove the screw 13 without first breaking off the tabs 14 that have been staked.

Figure 3:
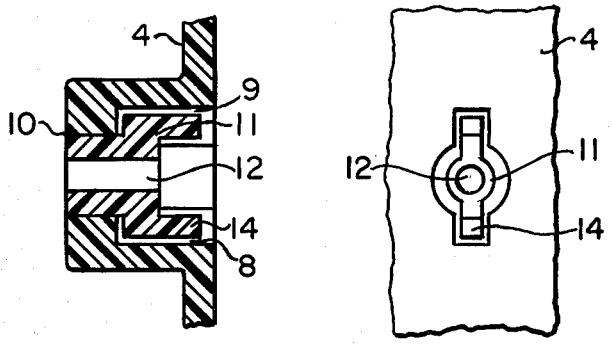
FIG. 3 is a cut away view of the security seal insert when it is put into position into the cover of the postage meter.
Figure 4:
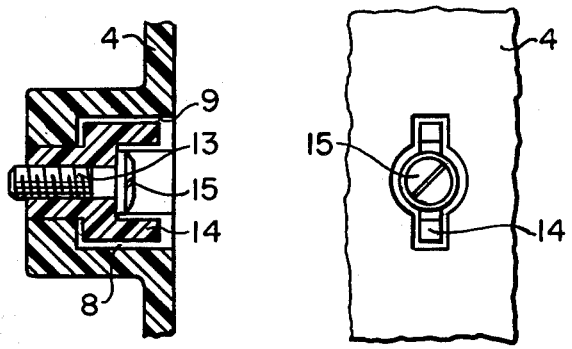
FIG. 4 is a cross sectional veiw of the security seal of this invention wherein the screw is inserted into the security seal insert.

In FIGS. 3 and 4, the security sealing means 7 is illustrated in break away relation to postage meter cover of panel 4. The security seal insert 11 is shown in position after insertion into the cut out portion 9 on the panel 4. Security seal insert 11 is shown with empty screw bore or tunnel 12 positioned therein. The security seal insert 11 is fixed into position in the cut out portion 8 and adapted to receive in bore 12 a screw 13. In FIG. 4, screw 13 is shown fixed in position through security insert seal 11 connecting said insert 11 to meter frame and trapping panel 4. Screw 13 after it has been inserted into screw bore 12 will extend through security insert to connect security insert 11 to frame. Shown extending above the top of the security seal insert 11 are tabs 14 which in FIG. 4 are shown just prior to being staked over the head 15 of screw 13.

Figure 5:
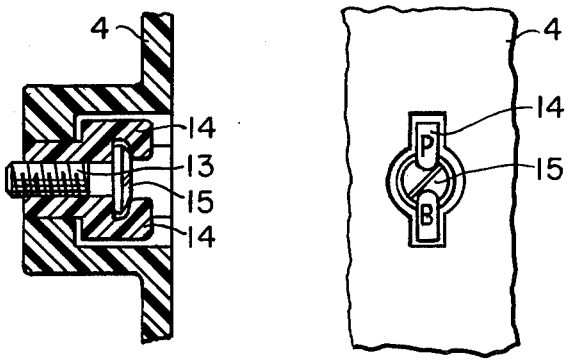
FIG. 5 is a cross sectional view of the cover, the security seal insert, with the screw therein having the tabs melted or staked over the screw head.

FIG. 5 shows screw 13 inserted into security seal insert 11 and connecting said insert 11 to frame of the postage meter. Tabs 14 have been ultrasonically staked over the head 15 of screw 13 therefore locking screw 13 into security seal insert 11. Once the two tabs 14 have been staked over screw heads 15, the removal of screw 13 is impossible without first breaking off tabs 14 from the top of screw heads 15. Staked tabs 14 may be pried off head 15 of the screw by any suitable means such as a screw driver or other appropriate tool. Once the tabs 14 have been broken, screw 13 can be turned and loosened by any suitable device. Screw 13 is then loosened up, removed from the security seal insert 11 and the panel 4 removed from the back portion or the preferred position at the bottom portion of postage meter 1. Once panel 4 has been removed, servicing of the interior of postage meter 1 can take place. To reuse, the broken insert 11 is removed and new inserts are pressed into seal receiving element 10. A screw is then inserted into the screw bore hole 12, tightened, and the staking of tabs 14 again takes place to secure the screw 13 into position.

The instant invention has been shown and described in what is considered to be the most practical and preferred embodiment. It is to be understood, however, that other modifications and ramifications will become apparent to those skilled in the art upon a reading of this disclosure; these are considered to be within the spirit of the present invention.

What is claimed is:

1. A security sealing means for locking the housing of a postage meter, the housing including a housing panel having an aperture, the security sealing means comprising: an insert adapted to fit into and mate with the aperture of the housing panel of the postage meter the insert having a screw bore adjusted to receive a screw and having breakable tabs adapted to be melted over the head of the screw.

2. The sealing means of claim 1 wherein said tabs are located at diametrically opposite portions of said insert.

3. The sealing means of claim 1 wherein said tabs are constructed of a substantially breakable material not readily repaired by an adhesive.

4. The sealing means of claim 1 wherein said insert has a circular configuration with said tabs located on its outer periphery, said tabs extending upwardly and away from said circular portion.

5. The sealing means of claim 1 wherein said screw is a break-off screw.

6. The sealing means of claim 1 wherein said tabs are constructed of a material that can readily be staked by ultrasonic means.

7.The sealing means of claim 1 wherein said insert is removably fitted into said panel and temporarily affixed thereto by a break-off screw.

8. The sealing means of claim 1 wherein said breakable tabs are constructed of a linear polyoxyalkylene-acetal resin.

9. A postage meter security sealing means comprising a postage meter housing and a security seal insert, said housing containing an opening that extends through the thickness of said housing, the insert being removably fitted into the panel and being temporarily affixed thereto by a break-off screw said insert being of circular configuration and having two tabs extending upwardly and away from the main portion of said insert, and a screw bore hole positioned centrally in said insert and adapted to receive a screw to achieve attachment of said insert to said postage meter housing.

10. The sealing means of claim 9 wherein said housing opening is slightly larger than and of the same geometrical configuration as said insert.

11. The sealing means of claim 9 wherein said tabs are located at diametrically opposite portions of said insert.

12. The sealing means of claim 9 wherein said tabs are constructed of a substantially frangible material that cannot be readily repaired once broken.

13. The sealing means of claim 9 wherein said insert has a circular configuration having said tabs located on its outer periphery, said tabs extending upwardly away from said circular portion.

14. The sealing means of claim 9 wherein screw is a break-off screw.

15. The sealing means of claim 9 wherein said tabs are constructed of a material that is adapted to be staked by ultrasonic means.

16. The sealing means of claim 9 wherein said breakable tabs are constructed of a linear polyoxyalkylene-type acetal resin.

* * * * *